US010751729B2

(12) United States Patent
Tolvanen

(10) Patent No.: US 10,751,729 B2
(45) Date of Patent: Aug. 25, 2020

(54) ELECTROSTATIC PRECIPITOR

(71) Applicant: Valmet Technologies Oy, Espoo (FI)

(72) Inventor: Juha Tolvanen, Helsinki (FI)

(73) Assignee: Valmet Technologies Oy, Espoo (FI)

( * ) Notice: Subject to any disclaimer, the term of this patent is extended or adjusted under 35 U.S.C. 154(b) by 347 days.

(21) Appl. No.: 15/842,439

(22) Filed: Dec. 14, 2017

(65) Prior Publication Data

US 2018/0178222 A1 Jun. 28, 2018

(30) Foreign Application Priority Data

Dec. 22, 2016 (FI) ..... 20166023

(51) Int. Cl.

| | |
|---|---|
| ***B03C 3/08*** | (2006.01) |
| ***B03C 3/02*** | (2006.01) |
| ***B03C 3/47*** | (2006.01) |
| ***B03C 3/41*** | (2006.01) |
| ***B03C 3/68*** | (2006.01) |
| *B03C 3/013* | (2006.01) |

(52) U.S. Cl.

CPC ..... *B03C 3/08* (2013.01); *B03C 3/025* (2013.01); *B03C 3/41* (2013.01); *B03C 3/47* (2013.01); *B03C 3/68* (2013.01); *B03C 3/013* (2013.01)

(58) Field of Classification Search

CPC combination set(s) only.
See application file for complete search history.

(56) References Cited

U.S. PATENT DOCUMENTS 3,701,236 A 10/1972 Rotsky et al.
4,097,252 A * 6/1978 Kirchhoff ..... B03C 3/36 110/119

(Continued)

FOREIGN PATENT DOCUMENTS

CL 2014003499 A1 5/2015
CN 201227601 Y 4/2009

(Continued)

OTHER PUBLICATIONS

European Patent Office, Extended European Search Report for Application No. 17209811.3, dated May 15, 2018, 3 pages, Germany.

(Continued)

*Primary Examiner* — Christopher P Jones
*Assistant Examiner* — Sonji Turner
(74) *Attorney, Agent, or Firm* — Alston & Bird LLP

(57) ABSTRACT

An electrostatic precipitator for removing particulates from boiler fine gas is provided. The electrostatic precipitator comprises discharge electrodes and collecting electrodes fitted in a gas passage, the electrodes being arranged in at least two electrical fields that are placed successively in relation to gas flow, and the electrical field establishing at least one electrical unit in transversal direction of said gas passage. The at least one electrical unit has the ability to be de-energised independently, separately from the other electrical units of the electrostatic precipitator. The first electrical field of the at least two electrical fields is also arranged first in the gas flow, and the first electrical field comprises more electrical units than a second field following the first field.

5 Claims, 2 Drawing Sheets

(56) References Cited

U.S. PATENT DOCUMENTS

| | | | | |
|---|---|---|---|---|
| 4,218,225 | A * | 8/1980 | Kirchhoff | B03C 3/74 96/32 |
| 4,238,203 | A * | 12/1980 | Jaworowski | B03C 3/013 95/60 |
| 4,432,062 | A * | 2/1984 | Herklotz | B03C 3/763 95/26 |
| 5,779,764 | A | 7/1998 | Gillen et al. | |
| 7,261,765 | B2 * | 8/2007 | Katayama | B03C 3/025 323/903 |
| 7,502,701 | B2 * | 3/2009 | Grass | B03C 3/68 702/64 |
| 7,582,144 | B2 * | 9/2009 | Krigmont | B03C 3/025 96/16 |
| 7,704,302 | B2 * | 4/2010 | Abdelkrim | B03C 3/08 95/5 |
| 7,736,418 | B2 * | 6/2010 | Graβ | B03C 3/68 95/2 |
| 8,007,566 | B2 * | 8/2011 | Abdelkrim | B03C 3/08 95/5 |
| 8,268,040 | B2 * | 9/2012 | Boyden | B03C 3/763 95/5 |
| 8,328,902 | B2 * | 12/2012 | Boyden | B03C 3/763 95/5 |
| 8,414,687 | B2 * | 4/2013 | Li | B03C 3/08 95/74 |
| 8,999,040 | B2 * | 4/2015 | Johansson | B03C 3/763 95/76 |
| 9,039,815 | B2 * | 5/2015 | Dunn | B03C 3/41 96/70 |
| 9,073,062 | B2 * | 7/2015 | Dunn | B03C 3/47 |
| 9,132,434 | B2 * | 9/2015 | Ranstad | B03C 3/68 |
| 9,238,230 | B2 * | 1/2016 | Dunn | B03C 3/45 |
| 9,845,952 | B2 | 12/2017 | Tolvanen | |
| 2006/0137528 | A1 | 6/2006 | Katayama | |
| 2016/0288138 | A1 * | 10/2016 | Tsai | B03C 3/47 |

FOREIGN PATENT DOCUMENTS

| | | | | |
|---|---|---|---|---|
| CN | 102302979 | A | 1/2012 | |
| CN | 102631990 | A | 8/2012 | |
| CN | 203425921 | U * | 1/2014 | |
| CN | 203425921 | U | 2/2014 | |
| CN | 104525376 | A | 4/2015 | |
| CN | 105478237 | A | 4/2016 | |
| CN | 103547373 | B | 9/2016 | |
| EP | 1967276 | A1 | 9/2008 | |
| EP | 3338894 | A1 | 6/2018 | |
| GB | 1073901 | A * | 6/1967 | B03C 3/40 |
| GB | 2447125 | A | 9/2008 | |

OTHER PUBLICATIONS

Chilean Patent Office, Office Action for Patent Application No. 2017-003265, dated Mar. 8, 2019, 9 pages, Chile (English Translation Not Available).

China National Intellectual Property Administration, Office Action for Patent Application No. 201711385219.8, 11 pages, China.

Finnish Patent and Registration Office, Office Action for Application No. 20166023, dated Jul. 7, 2017, 5 pages, Finland.

Finnish Patent and Registration Office, Search Report for Application No. 20166023, dated Jul. 7, 2017, 2 pages, Finland.

Instituto Nacional De Propiedad Industrial (INAPI)—Chilean Patent Office, Office Action for Chilean Patent Application No. 201703265, dated Sep. 3, 2019, (9 pages), Chile.

* cited by examiner

ELECTROSTATIC PRECIPITOR

CROSS REFERENCE TO RELATED APPLICATIONS

This application claims priority to Finnish Patent Application No. 20166023, filed on Dec. 22, 2016, the contents of which as are hereby incorporated by reference in their entireties.

BACKGROUND

Related Field

The invention relates to an electrostatic precipitator for removing particulates from boiler flue gas, the electrostatic precipitator comprising discharge electrodes and collecting electrodes fitted in a gas passage, said electrodes being arranged in at least two electrical fields that are placed successively in relation to gas flow, the electrical field establishing at least one electrical unit in transversal direction of said gas passage, the electrical unit constituting a portion of the precipitator having ability to be de-energised independently, separately from the other electrical units of the electrostatic precipitator, the first electrical field of said at least two electrical fields arranged to be first in said gas flow.

Description of Related Art

Electrostatic precipitators use electrical fields to remove particulates from gas streams, such as boiler flue gas, e.g. of chemical recovery boiler, e.g. black liquor recovery boiler or kraft recovery boiler. Precipitators electrically charge particulates to be removed from gases, and tend not to otherwise affect the gases. Electrostatic precipitators typically have low pressure drops, energy requirements and operating costs.

In an electrostatic precipitator, an intense electric field is maintained between high-voltage discharge electrodes. A corona discharge from the discharge electrodes ionizes the flue gas passing between the collecting electrodes. The ionized gas ionizes fly ash and other particles in the flue gas. The electric field between the discharge electrodes and collecting electrodes drives the negatively charged particles to the collecting electrodes. Periodically, the collecting electrodes are rapped mechanically (in dry electrostatic precipitators) or washed (in wet electrostatic precipitators) to dislodge the collected particles, which fall into hoppers for removal.

A problem with the electrostatic precipitators is that sparking can occur between the discharge and collecting electrodes. Sparking limits the electrical energization of the electrostatic precipitator. Sparking occurs when the ionized gas in the precipitator has a localized breakdown such that current rises rapidly and voltage drops between one or more electrodes. During spark the current can reach over normal operating current. Spark between electrodes create a current path disrupts an otherwise even distribution of current in the electrical field between the electrodes. Sparking can damage internal the electrodes and other components of an electrostatic precipitator.

As a solution to the above-mentioned problem, it is common practice to split the electrostatic precipitator into separate electrical units, both in the width and length, and to energize each section with its own electrical equipment, the electrical unit having thus ability to be de-energised independently, separately from the other electrical units.

This solution has, however, the problem that it has complicated structure, thus being expensive to erect and maintain.

BRIEF SUMMARY

Viewed from a first aspect, there can be provided an electrostatic precipitator for removing particulates from boiler flue gas, the electrostatic precipitator comprising discharge electrodes and collecting electrodes fitted in a gas passage, said electrodes being arranged in at least two electrical fields that are placed successively in relation to gas flow, the electrical field establishing at least one electrical unit in transversal direction of said gas passage, the electrical unit constituting a portion of the precipitator having ability to be de-energised independently, separately from the other electrical units of the electrostatic precipitator, the first electrical field of said at least two electrical fields arranged to be first in said gas flow, wherein the first electrical field comprises more electrical units than a second field following said first field.

Thereby a simple and inexpensive electrical precipitator may be achieved.

The electrical precipitator is characterised by what is stated in the characterising part of the independent claim. Some other embodiments are characterised by what is stated in the other claims. Inventive embodiments are also disclosed in the specification and drawings of this patent application. The inventive content of the patent application may also be defined in other ways than defined in the following claims. The inventive content may also be formed of several separate inventions, especially if the invention is examined in the light of expressed or implicit sub-tasks or in view of obtained benefits or benefit groups. Some of the definitions contained in the following claims may then be unnecessary in view of the separate inventive ideas. Features of the different embodiments of the invention may, within the scope of the basic inventive idea, be applied to other embodiments.

BRIEF DESCRIPTION OF THE FIGURES

Some embodiments illustrating the present disclosure are described in more detail in the attached drawings, in which.

In the figures, some embodiments are shown simplified for the sake of clarity. Similar parts are marked with the same reference numbers in the figures.

DETAILED DESCRIPTION OF VARIOUS EMBODIMENTS

Figure 1A:
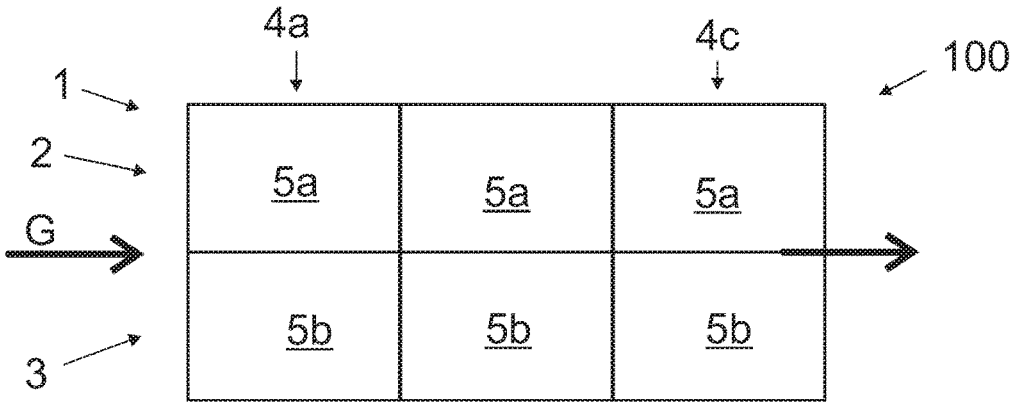
Prior Art Fig. 1a
FIG. 1*a* is a schematic side view of a prior art solution of an electrostatic precipitator from above.
Figure 1B:
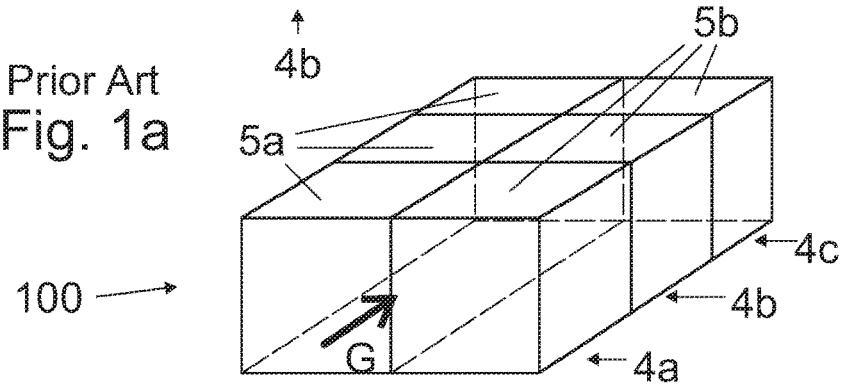
Prior Art Fig. 1b
FIG. 1*b* is a schematic perspective view of the electrostatic precipitator shown in FIG. 1*a,*

FIG. 1 is a schematic side view of a prior art solution of an electrostatic precipitator from above, and FIG. 1*b* is a schematic perspective view of the electrostatic precipitator shown in FIG. 1*a.*

The electrostatic precipitator 100 comprises discharge electrodes 1 and collecting electrodes 2 fitted in a gas passage 3. The electrodes 1, 2 are arranged in three electrical fields 4*a*, 4*b*, 4*c* that are placed successively in relation to gas flow G.

Each of the electrical fields 4*a*, 4*b*, 4*c* establishes two electrical units 5*a*, 5*b* arranged in transversal direction of the gas passage 3.

The electrical unit 5*a*, 5*b* constitutes a portion of the electrostatic precipitator 100 that has ability to be de-energised independently, separately from the other electrical units 5*a*, 5*b* of said electrostatic precipitator 100.

Figure 2A:
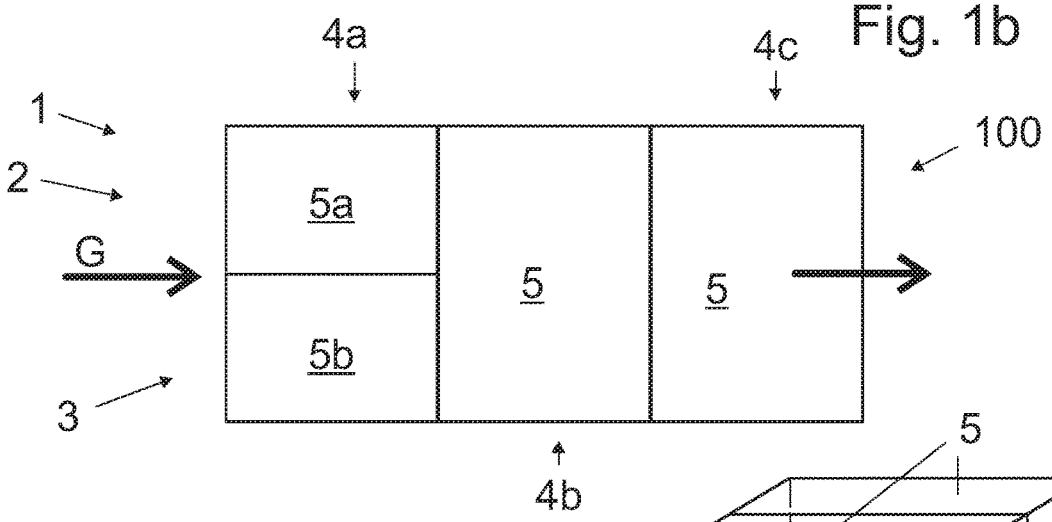
FIG. 2*a* is a schematic top view of an electrostatic precipitator.
Figure 2B:
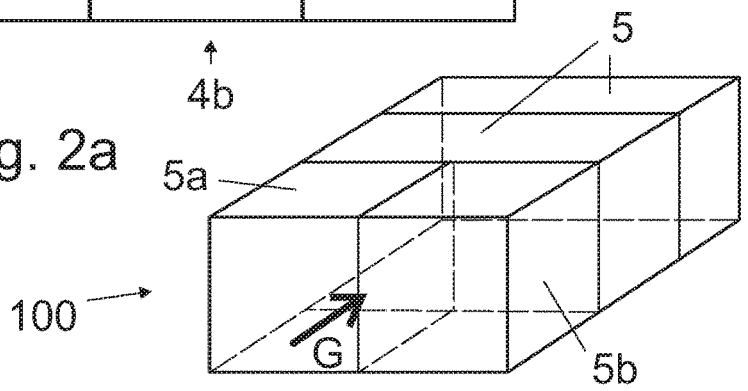
FIG. 2*b* a schematic perspective view of the electrostatic precipitator shown in FIG. 2*a,*

FIG. 2*a* is a schematic top view of an electrostatic precipitator according to the invention, and FIG. 2*b* a schematic perspective view of the electrostatic precipitator shown in FIG. 2*a*.

The electrostatic precipitator 100 comprises discharge electrodes 1 and collecting electrodes 2 arranged in at least two electrical fields that are placed successively in relation to gas flow G in a gas passage 3. The embodiment shown here comprises three electrical fields 4*a*, 4*b*, 4*c*. It is to be noted, however, that the number of the electrical fields may vary from two to eight, or even to higher numbers.

The electrical fields 4*a*, 4*b*, 4*c* establish at least one electrical unit in transversal direction of the gas passage 3. In the embodiment shown in FIGS. 2*a*, 2*b*, the first electrical field 4*a* comprises two electrical units 5*a*, 5*b*, whereas each of second and third fields 4*b*, 4*c* following said first field comprises one electrical unit 5 only. In other words, in the first electrical field 4*a* the cross section of the gas passage 3 has divided in two electrical units 5*a*, 5*b*, but there is no such division in the second and third electrical fields 4*b*, 4*c*. Thus, the gas flow G flowing through the first electrical field 4*a* flows through the two electrical units 5*a*, 5*b*, and then through one electrical unit 5 in the second electrical field 4*b* and finally through one electrical unit 5 in the third electrical field 4*c*.

In the electrical unit 5, 5*a*, 5*b* there is maintained an intense electric field between high-voltage discharge electrodes, typically wires, bars or rigid frames, and grounded collecting electrodes, typically parallel plates arranged vertically.

The gas flow G flows through the through a gap between the discharge electrode and the collecting electrode, whereby the gas is ionized by the voltage potential. Particulates contained by the gas are charged and collected on the collecting electrode to remove the particulates from the gas.

In another embodiment, it is arranged three electrical units (5*a*, 5*b*, 5*c*), or even more electrodes, in the first electrical field 4*a*, and only one electrical unit 5 in each of the second electrical field 4*b* and further electrical field(s), if any.

Generally speaking, if the number of the electrical units in the first electrical field 4*a* is marked as "X", then the maximum number of the electrical units in the second electrical field 4*b* is "X−1" (X subtracted by 1).

Sparks between electrodes create a current path that disrupts an otherwise even distribution of current in the electric field between electrodes. Sparking can damage internal the electrodes and other components of an electrostatic precipitator.

The first electrical field 4*a* receives the gas flow G, and thus at least practically all the particles contained by the gas, while the second electrical field 4*b*, and further electrical fields, if any, receive gas flow that has passed the first electrical filed 4*a* and comprises thus substantially lowered particle content. Therefore, sparkling takes place most frequently in the first electrical field 4*a*. According to an experiment made by the inventor, the sparkling rate, i.e. number of sparks per minute (spm) was 200-300 spm in the first electrical field 4*a*, 0-10 spm in the second electrical field 4*b*, 0 spm in the third electrical field 4*c*. Thus the second electrical field 4*b* and further electrical fields, if any, can be structured to include less electrical units 5 than the first electrical field 4*a* without jeopardizing the effectiveness of the filtering process carried out by the electrostatic precipitator 100. An advantage of this kind of electrostatic precipitator 100 is that the construct of the precipitator 100 is to set two power supplier with control units for 5*a* and 5*b*. By doing this way amount of spm per control unit is only half than in the traditional solution. That is why control units can reach higher performance level than the traditional solution.

Figure 3A:
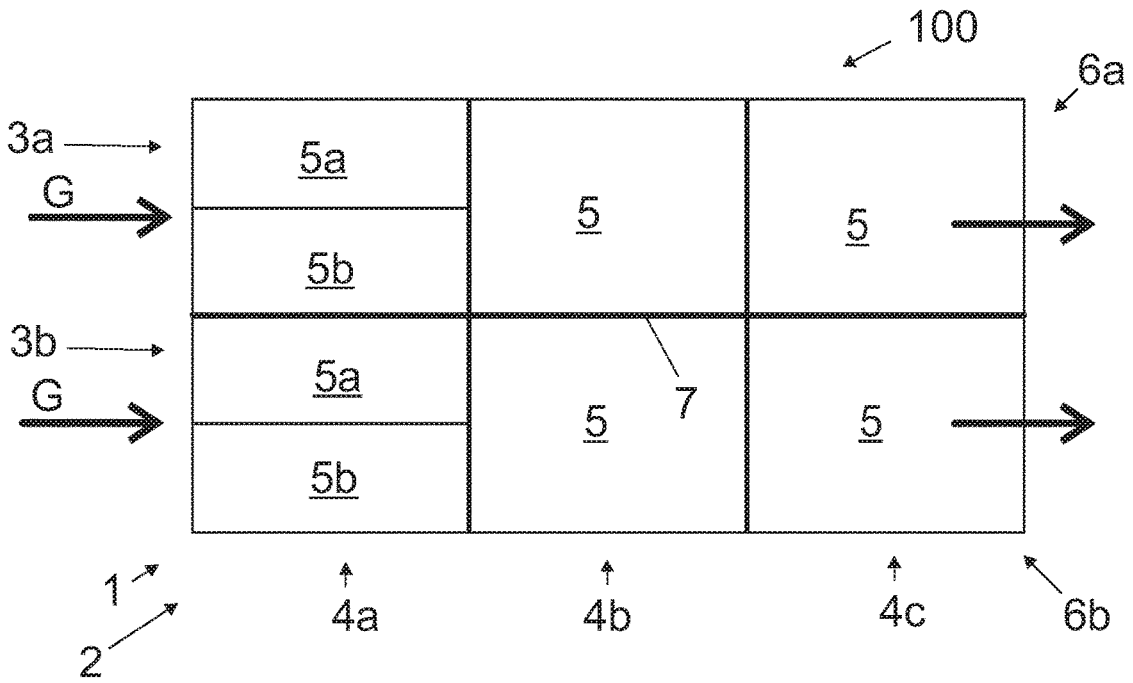
FIG. 3*a* is a schematic top view of another electrostatic precipitator, and FIG. 3*b* a schematic perspective view of the electrostatic precipitator shown in FIG. 3*a.*
Figure 3B:
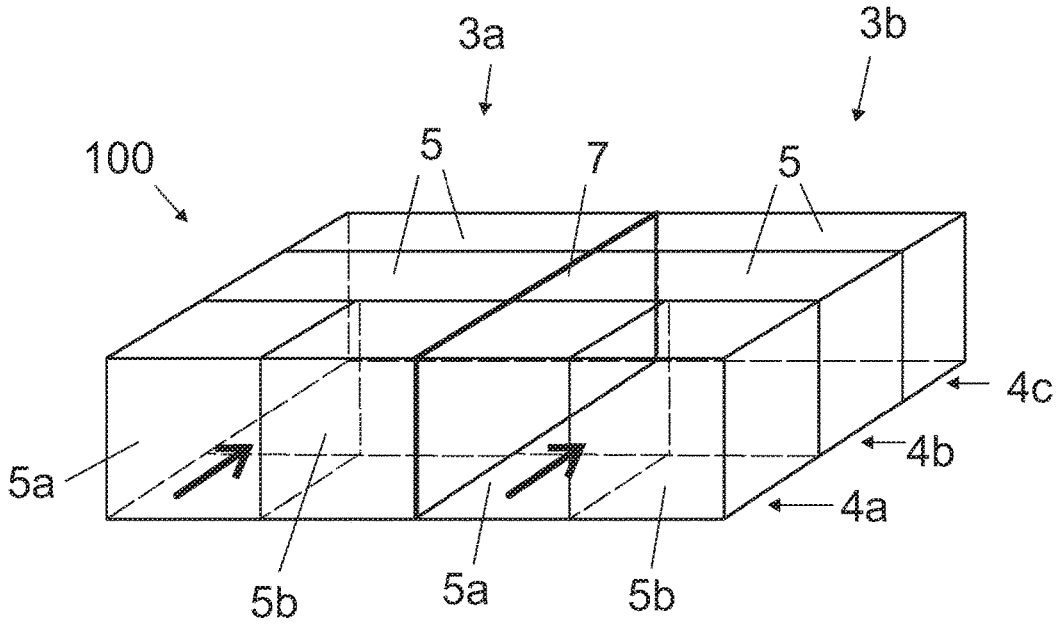

FIG. 3*a* is a schematic top view of another electrostatic precipitator according to the invention, and FIG. 3*b* a schematic perspective view of the electrostatic precipitator shown in FIG. 3*a*. It is to be noted here that dimensions of the electrostatic precipitator 100 may vary from those shown in Figures.

The structure of the electrostatic precipitator 100 is basically same as in FIGS. 2*a*, 2*b*. However, the electrostatic precipitator 100 shown in FIGS. 3*a*, 3*b* comprises two parallel structures 6*a*, 6*b* separated by a gas-tight division wall 7. The electrostatic precipitator 100 is thus divided into two independently working gas passages 3*a*, 3*b*. Each of the passages 3*a*, 3*b* comprises similar structure of electrical fields and electrical units as discussed above in connection with FIGS. 2*a*, 2*b*.

The embodiment shown in FIGS. 3*a*, 3*b* is especially useful in electrostatic precipitators 100 having very large dimensions.

It is to be noted, that the electrostatic precipitator 100 may be divided to three, or even more, parallel structures.

The electrostatic precipitators 100 according to the invention may be applied to variety of purification tasks. In an embodiment, the electrostatic precipitator 100 is used for removing particulates from flue gas of a kraft recovery boiler. In an embodiment, the electrostatic precipitator 100 is used for removing particulates from flue gas of a chemical recovery boiler.

The invention is not limited solely to the embodiments described above, but instead many variations are possible within the scope of the inventive concept defined by the claims below. Within the scope of the inventive concept the attributes of different embodiments and applications can be used in conjunction with or replace the attributes of another embodiment or application.

The drawings and the related description are only intended to illustrate the idea of the invention. The invention may vary in detail within the scope of the inventive idea defined in the following claims.

REFERENCE SYMBOLS

1 discharge electrode
2 collecting electrode
3, 3*a*, *b* gas passage
4*a*, *b*, *c* electrical field
5, 5*a*, *b* electrical unit
6*a*, 6*b* parallel structure
7 division wall
100 electrostatic precipitator
G gas flow

The invention claimed is:

1. An electrostatic precipitator for removing particulates from boiler flue gas, the electrostatic precipitator comprising a number of first electrical units in a passage that receives boiler flue gas flow, each first electrical unit comprising at least one discharge electrode and at least one collecting electrode for forming an electric field inside said first electrical unit, the first electrical units being first in the boiler flue gas flow, a number of second electrical units arranged after the first electrical units in relation to the boiler flue gas flow, each second electrical unit comprising at least one discharge electrode and at least one collecting electrode for forming an electric field inside said second electrical unit, each electrical unit constituting a portion of the electrostatic precipitator having ability to be de-energised independently, separately from the other electrical units of the electrostatic precipitator, and the number of the first electrical units being greater than the number of the second electrical units.

2. The electrostatic precipitator as claimed in claim 1, wherein the number of the first electrical units is two and the number of the second electrical units is one.

3. The electrostatic precipitator as claimed in claim 1, wherein following the second electrical unit there is arranged a number of additional successive electrical units, each of the additional successive electrical units comprising an equal number of units with the second electrical units.

4. The electrostatic precipitator as claimed in claim 3, wherein the number of the additional successive electrical units is 2 to 8.

5. The electrostatic precipitator as claimed in claim 1, comprising at least two parallel and independently operating gas passages separated by a gas-tight division wall.

* * * * *